US008656674B1

(12) United States Patent
Woodward

(10) Patent No.: US 8,656,674 B1
(45) Date of Patent: Feb. 25, 2014

(54) MAGNETIC TILE

(76) Inventor: Christopher G. Woodward, Tacoma, WA (US)

( * ) Notice: Subject to any disclaimer, the term of this patent is extended or adjusted under 35 U.S.C. 154(b) by 0 days.

(21) Appl. No.: 13/485,063

(22) Filed: May 31, 2012

Related U.S. Application Data

(60) Provisional application No. 61/491,613, filed on May 31, 2011.

(51) Int. Cl.
*E04F 13/08* (2006.01)

(52) U.S. Cl.
USPC ..... 52/388

(58) Field of Classification Search
USPC ..... 52/388, 390, DIG. 4, 391, 392, 506.01
See application file for complete search history.

(56) References Cited

U.S. PATENT DOCUMENTS

| | | | | | |
|---|---|---|---|---|---|
| 2,242,835 | A | * | 5/1941 | Price | 52/410 |
| 2,265,614 | A | * | 12/1941 | Schmohl | 52/388 |
| 2,734,007 | A | * | 2/1956 | Toulmin, Jr | 428/161 |
| 3,341,996 | A | | 9/1967 | Jones et al. | |
| 3,378,974 | A | * | 4/1968 | Bush, Jr. | 52/506.05 |
| 3,609,934 | A | * | 10/1971 | O'Carroll | 52/461 |
| 3,629,756 | A | * | 12/1971 | Holtz | 335/285 |
| 3,740,911 | A | * | 6/1973 | O'Leary | 52/388 |
| 3,815,308 | A | * | 6/1974 | Corey | 52/316 |
| 3,975,813 | A | | 8/1976 | Bell | |
| 4,397,900 | A | * | 8/1983 | Higgins | 428/95 |
| 5,238,721 | A | * | 8/1993 | Nakazawa | 428/44 |
| 5,271,200 | A | | 12/1993 | Witt | |
| 5,363,579 | A | * | 11/1994 | Plumly | 40/600 |
| 5,476,559 | A | * | 12/1995 | Chiro | 156/71 |
| 5,524,373 | A | | 6/1996 | Plumly | |
| 5,634,309 | A | * | 6/1997 | Polen | 52/392 |
| 5,752,357 | A | * | 5/1998 | Piller | 52/747.11 |
| 5,816,005 | A | * | 10/1998 | Han | 52/391 |
| 5,927,033 | A | | 7/1999 | Kreckl | |
| 7,036,284 | B1 | * | 5/2006 | Larson | 52/506.1 |
| 7,125,595 | B2 | * | 10/2006 | Kobayashi | 428/67 |
| 7,624,551 | B2 | * | 12/2009 | Thronicke et al. | 52/388 |
| 8,132,377 | B2 | * | 3/2012 | Julton | 52/302.1 |
| 2003/0131549 | A1 | * | 7/2003 | Kappeli et al. | 52/390 |
| 2005/0276982 | A1 | | 12/2005 | Manchee | |
| 2008/0110122 | A1 | * | 5/2008 | Lehane et al. | 52/506.07 |
| 2008/0202053 | A1 | * | 8/2008 | Guy et al. | 52/391 |
| 2009/0301019 | A1 | * | 12/2009 | Baldock et al. | 52/506.1 |

* cited by examiner

*Primary Examiner* — Mark Wendell
*Assistant Examiner* — Keith Minter
(74) *Attorney, Agent, or Firm* — Robert C. Montgomery; Montgomery Patent & Design

(57) ABSTRACT

A magnetic tile with a magnetic backing to enable attachment of magnetic objects to the tiles comprises an outer surface providing an aesthetic covering. A rear surface of the tile comprises an integral lattice constructed of a ferromagnetic material. The lattice provides a magnetic field allowing a magnetic object to be secured to the outer surface of the tile.

7 Claims, 5 Drawing Sheets

MAGNETIC TILE

RELATED APPLICATIONS

The present invention was first described in and claims the benefit of U.S. Provisional Application No. 61/491,613, filed May 31, 2011, the entire disclosures of which are incorporated herein by reference.

FIELD OF THE INVENTION

The present invention relates generally to decorative tiles, and in particular, to a decorative tile having a magnetic backing.

BACKGROUND OF THE INVENTION

Suction cups are frequently used to hold shower curtains, small mirrors, shelves, and other small objects in bathroom and kitchen locations. They provide a handy non-permanent means of attaching various objects. However, the use of suction cups requires that the surface be completely flat and smooth to allow for an airtight connection. Even so, many suction cups will lose their suction over time and fail, causing the device to fall to the floor with often disastrous results that impact one's safety. Accordingly, there exists a need for a means by which the ease and benefits of temporary surface mounting can be provided on surfaces which are not completely flat and smooth and will not fail over time. The development of the magnetic tile will serve to alleviate these concerns.

Various attempts have been made to provide a magnetic tile. Examples of these attempts can be seen by reference to several U.S. patents. U.S. Pat. No. 3,341,996, issued in the name of Jones, describes flooring structures comprising a floor covering layer containing magnetic material. This patent discloses floor tiles having a magnetic material affixed to the tiles and a second magnetic material affixed to a surface for the purpose of attaching the floor tiles with a magnetic force. This patent does not disclose a tile with a back surface comprising a magnetic lattice that is designed to permanently attach to a surface.

U.S. Pat. No. 5,271,200, issued in the name of Witt, describes a title display system. This patent discloses a set of decorative tiles comprising a magnetic means that are designed to attach to a metallic subflooring. This patent does not disclose a tile with a back surface comprising a magnetic lattice that is designed to permanently attach to a surface.

U.S. Pat. No. 5,927,033, issued in the name of Kreckl, describes a system for laying wall or floor tiles or wall or floor plates. This patent discloses a system for securing titles utilizing a flexible contact layer attached to the surface to be covered, a layer of magnetically conductive material attached to the contact layer, and a layer of decorative plates or tiles with a magnetic backing removably attached to the magnetically conductive material. This patent does not disclose a tile with a back surface comprising a magnetic lattice that is designed to permanently attach to a surface.

While these systems fulfill their respective, particular objectives, each of these references suffer from one or more disadvantages. Many such systems are not suited for temporarily attaching a magnetic object to the decorative surface of the tile. The tiles in the above patents would be removed along with the magnetic object due to the fact that the tiles are attached to the surface magnetically and not permanently. Accordingly, there exists a need for a magnetic tile without the disadvantages as described above. The development of the present invention substantially departs from the conventional solutions and in doing so fulfills this need.

SUMMARY OF THE INVENTION

The inventor has recognized the aforementioned inherent problems and lack in the art and observed that there is a need for a magnetic tile that allows for the temporary attachment of a magnetic object to the surface of the tile.

Accordingly, it is an object of the present embodiments of the invention to solve at least one of these problems. The inventor has addressed this need by developing a tile with an integral magnetic lattice.

To achieve the above objectives, it is an object of the present invention to provide an assembly utilizing a tile comprising a ferromagnetic mesh.

Another object of the present invention is where the assembly provides a magnetic attachment means for the temporary attachment of a magnetic object.

Yet still another object of the present invention is where the assembly is waterproof.

Yet still another object of the present invention is where the ferromagnetic mesh is secured to the rear surface of the tile.

Yet still another object of the present invention is where the tile is thin enough to allow magnetic attraction between a magnetic object and the underlying ferromagnetic mesh.

Yet still another object of the present invention is where the ferromagnetic mesh comprises a plurality of elongated strands that are arranged in a grid pattern resulting in the formation of apertures.

Yet still another object of the present invention is where the elongated strands are made of a ferromagnetic material such as iron, cobalt, or nickel.

Yet still another object of the present invention is where the dimensions of the ferromagnetic mesh are smaller than the dimensions of the tile so as not to expose the ferromagnetic mesh.

Yet still another object of the present invention is where the ferromagnetic mesh is bonded to the body of the tile during the manufacturing process.

Yet still another object of the present invention is to provide a method of utilizing the device that may be achieved by performing the following steps: obtaining a desired plurality of magnetic tile assemblies including a plurality of tiles and a corresponding plurality of meshes; applying an adhesive to a wall; taking one (1) tile and one (1) mesh; placing the mesh against a portion of the wall coated with the adhesive; placing the rear surface of the tile against the mesh so that the tile hides the mesh and contacts the adhesive through the apertures in the mesh; installing each of the plurality of tiles and meshes in this manner; allowing the adhesive to dry; applying grout to the spaces between the plurality of installed magnetic tile assemblies; smoothing the grout to evenly fill the spaces between the plurality of installed magnetic tile assemblies; allowing the grout to dry; and, utilizing the fully installed plurality of magnetic tile assemblies to temporarily secure magnetic objects.

Yet still another object of the present invention is to provide a method of utilizing the device that may be achieved by performing the following steps: obtaining a desired plurality of magnetic tile assemblies wherein each magnetic tile assembly is manufactured with a mesh affixed to a tile; applying an adhesive to a wall; placing the mesh of each magnetic tile assembly against a portion of the wall coated with the adhesive; allowing the adhesive to dry; applying grout to the spaces between the plurality of installed magnetic tile assemblies; smoothing the grout to evenly fill the spaces between the plurality of installed magnetic tile assemblies; allowing the grout to dry; and, utilizing the fully installed plurality of magnetic tile assemblies to temporarily secure magnetic objects.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
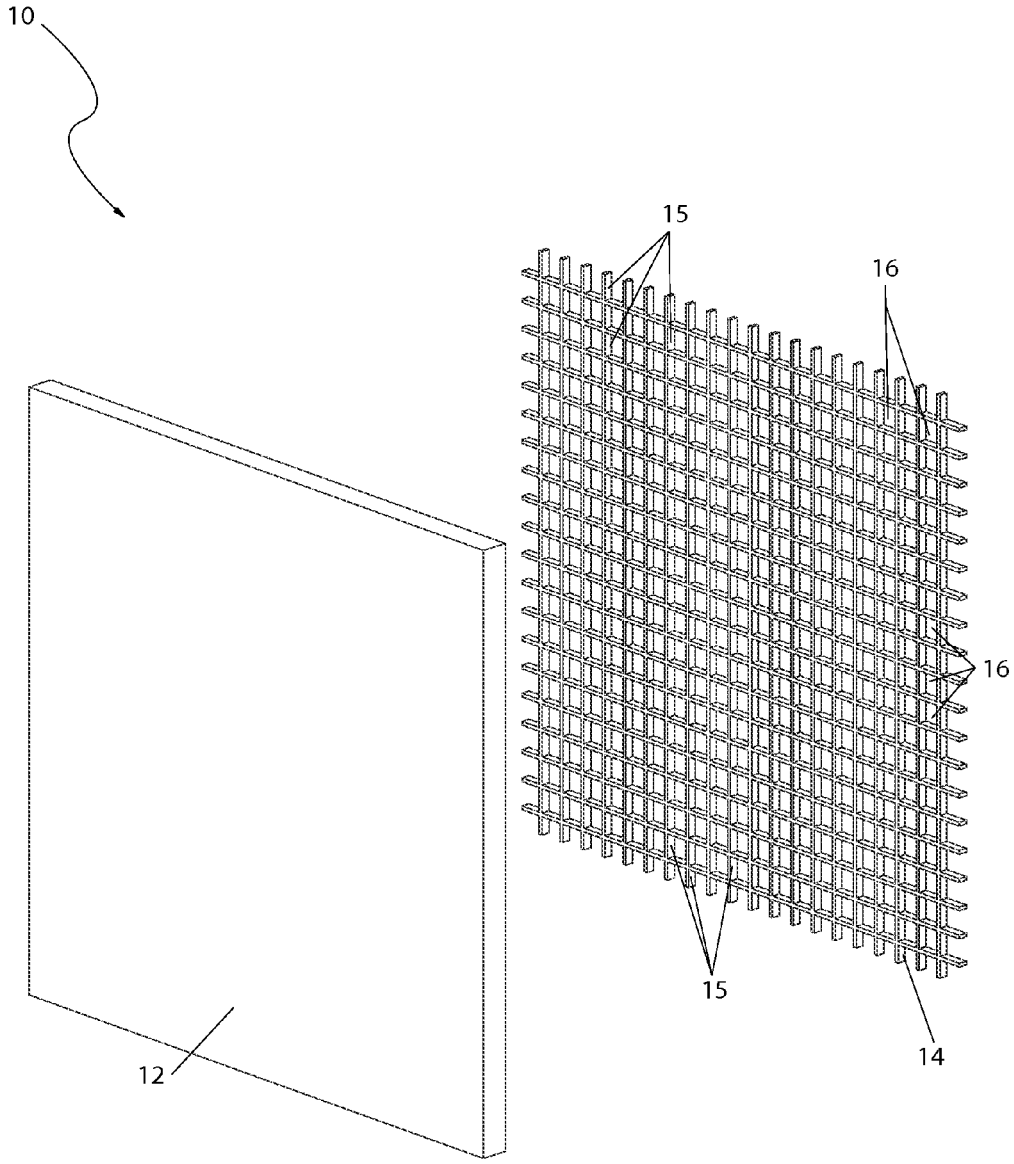
FIG. 1 is a front perspective view of a magnetic tile assembly 10, according to a preferred embodiment.

| DESCRIPTIVE KEY | |
|---|---|
| 10 | magnetic tile assembly |
| 12 | tile |
| 14 | ferromagnetic mesh |
| 15 | strands |
| 16 | apertures |
| 100 | wall |
| 102 | adhesive |
| 104 | grout |
| 110 | magnetic object |

DETAILED DESCRIPTION OF THE PREFERRED EMBODIMENT

The best mode for carrying out the invention is presented in terms of its preferred embodiment, herein depicted within the FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an object of a magnetic tile (herein described as the "assembly") 10, which provides a system and method by which a tile 12 is provided with a ferromagnetic mesh 14, thereby providing a magnetic attachment means to suspend a magnetic object 110 thereto. The assembly 10 is particularly suited for use on an interior wall 100 of a building. The assembly 10 is particularly adapted for use in bathrooms or kitchens where tile 12 walls are commonly installed. The assembly 10 is ferromagnetic so that magnetic objects 110 can be attached and removed on the wall 100.

Referring now to FIG. 1, a front perspective view of the assembly 10, is disclosed. The assembly 10 is intended to provide various benefits to a user over existing methods of attaching objects to the interior walls of a building. The assembly 10 is waterproof and can be used in showers. The assembly 10 temporarily secures magnetic objects 110 and thus is less prone to failure in a wet environment than existing methods. The assembly 10 provides all utilitarian and aesthetic features of a non-magnetic tile wall. The assembly 10 can be installed during new building projects or renovation to existing buildings.

The assembly 10 includes a tile 12 and a ferromagnetic mesh 14. The tile 12 is preferably used in multiples to cover a desired exposed portion of a wall 100 (see FIG. 4). The tile 12 is preferably a ceramic tile, but can be formed of any material used for interior building walls 100 including metal, stone, glass or wood without limiting the scope of the invention. The tile 12 is constructed in any desired shape, preferably a square shape. The tile 12 must comprise dimensions which are thin enough to permit magnetic attraction between a magnetic object 110 and the underlying ferromagnetic mesh 14.

The ferromagnetic mesh 14 includes a plurality of elongated strands 15 which cross in a grid-type pattern to form a plurality of apertures 16. In a preferred embodiment, the mesh 14 is a plurality of perpendicularly intersecting strands 15 forming a plurality of square apertures 16, although other geometrical configurations can be used to equal benefit. The strands 15 are formed from a ferromagnetic material such as iron, cobalt, or nickel. The apertures 16 enable adhesive 102 to penetrate and contact with the tile 12, thereby securing said tile 12 and ferromagnetic mesh 14 to the desire wall 100. The ferromagnetic mesh 14 comprises dimensions which are slightly smaller than the dimensions of the tile 12 as to not expose said ferromagnetic mesh 14 beyond said tile 12 (also see FIG. 2).

Figure 2:
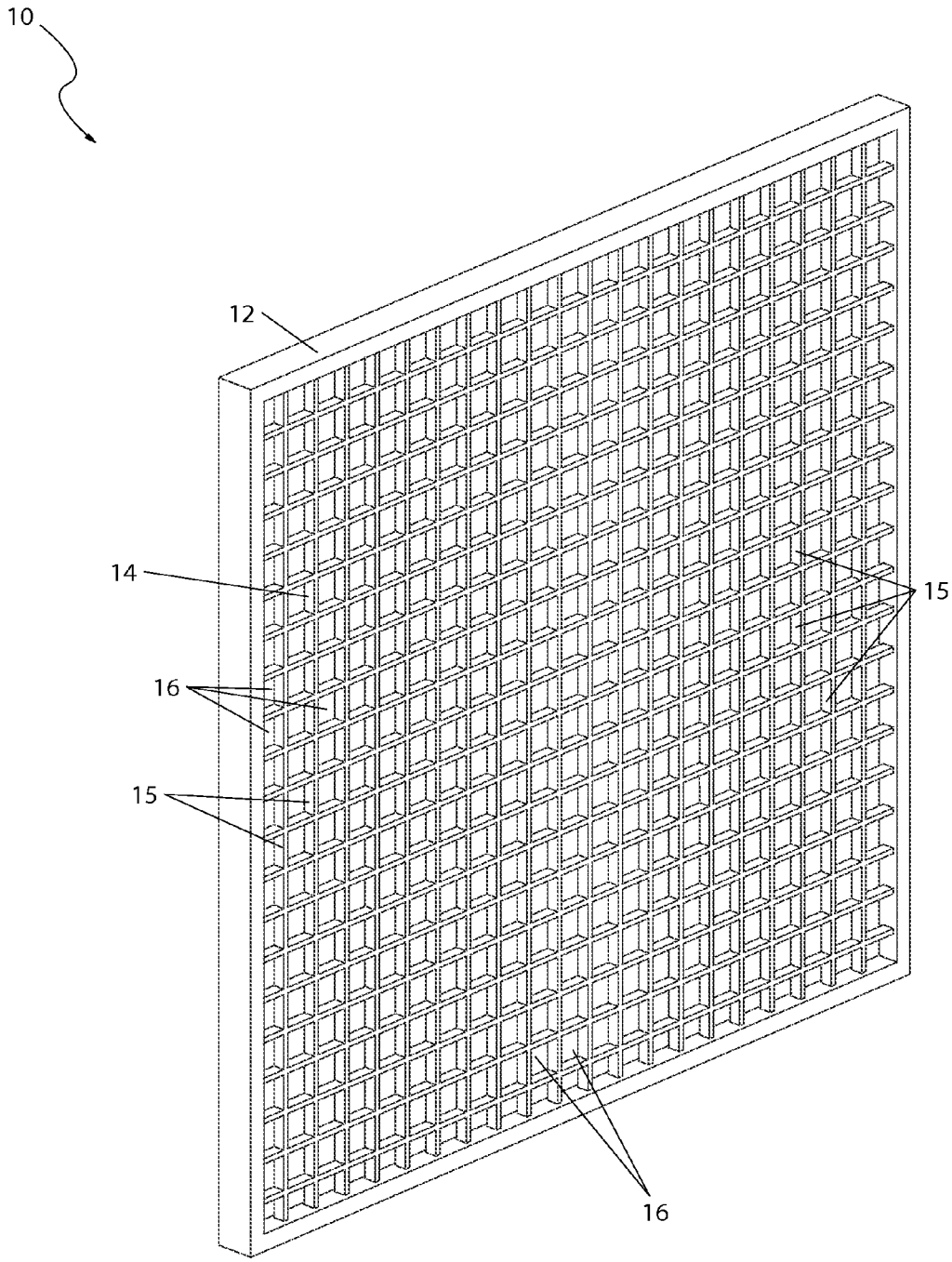
FIG. 2 is a rear perspective view of the magnetic tile assembly 10, according to the preferred embodiment.

Referring now to FIG. 2, a rear perspective view of the assembly 10, is disclosed. During installation or manufacture, the mesh 14 is secured to a rear surface of the tile 12. During installation, a user would utilize an adhesive 102 to secure the ferromagnetic mesh 14 to the tile 12 and the wall 100 (also see FIG. 3). During manufacturing, the ferromagnetic mesh 14 would be pressed into the body of the tile 12 prior to the drying and glazing processes. The perimeter shape of the mesh 14 is congruent to and slightly smaller than the perimeter shape of the tile 12 so that the mesh 14 is concealed behind the tile 12 after installation.

Figure 3:
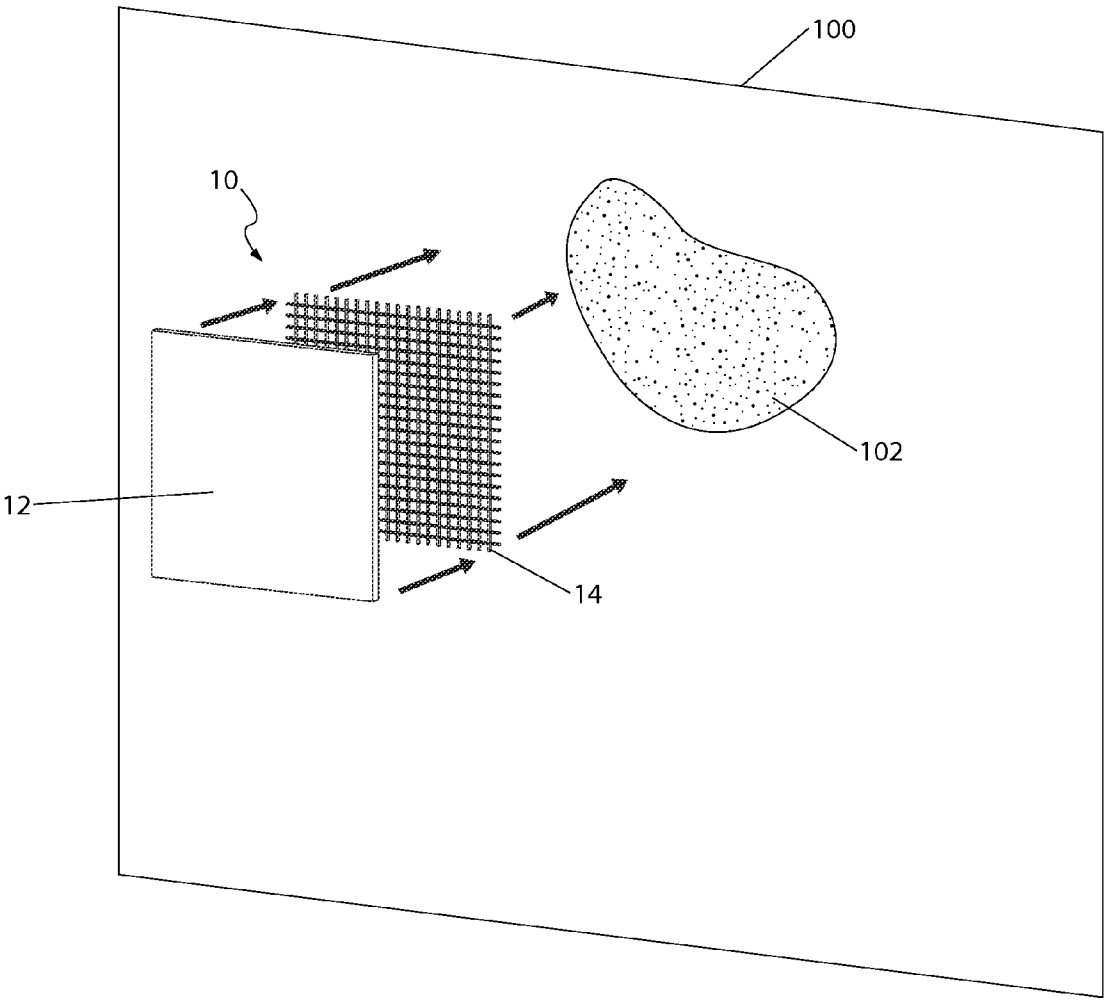
FIG. 3 is a front environmental view of the magnetic tile assembly 10 being installed on a wall 100, according to the preferred embodiment.

Referring now to FIG. 3, a front environmental view of the assembly 10 being installed on a wall 100, is disclosed. The wall 100 is preferably a waterproof substrate covered with a cement board layer commonly used in shower installations. The tile 12 is attached to the wall 100 by an adhesive 102. The adhesive 102 is preferably a thinset grout or similar mortar material. The adhesive 102 is applied to the entire portion of the wall 100 which is to be covered with a plurality of magnetic tile assemblies 10 in a desired pattern. In at least one (1) embodiment, the mesh 14 is attached to the tile 12 with the adhesive 102 during installation. The apertures 16 provide sufficient surface area for the adhesive 102 to bond the mesh 14 to the tile 12 and the tile 12 to the wall 100.

Figure 4:
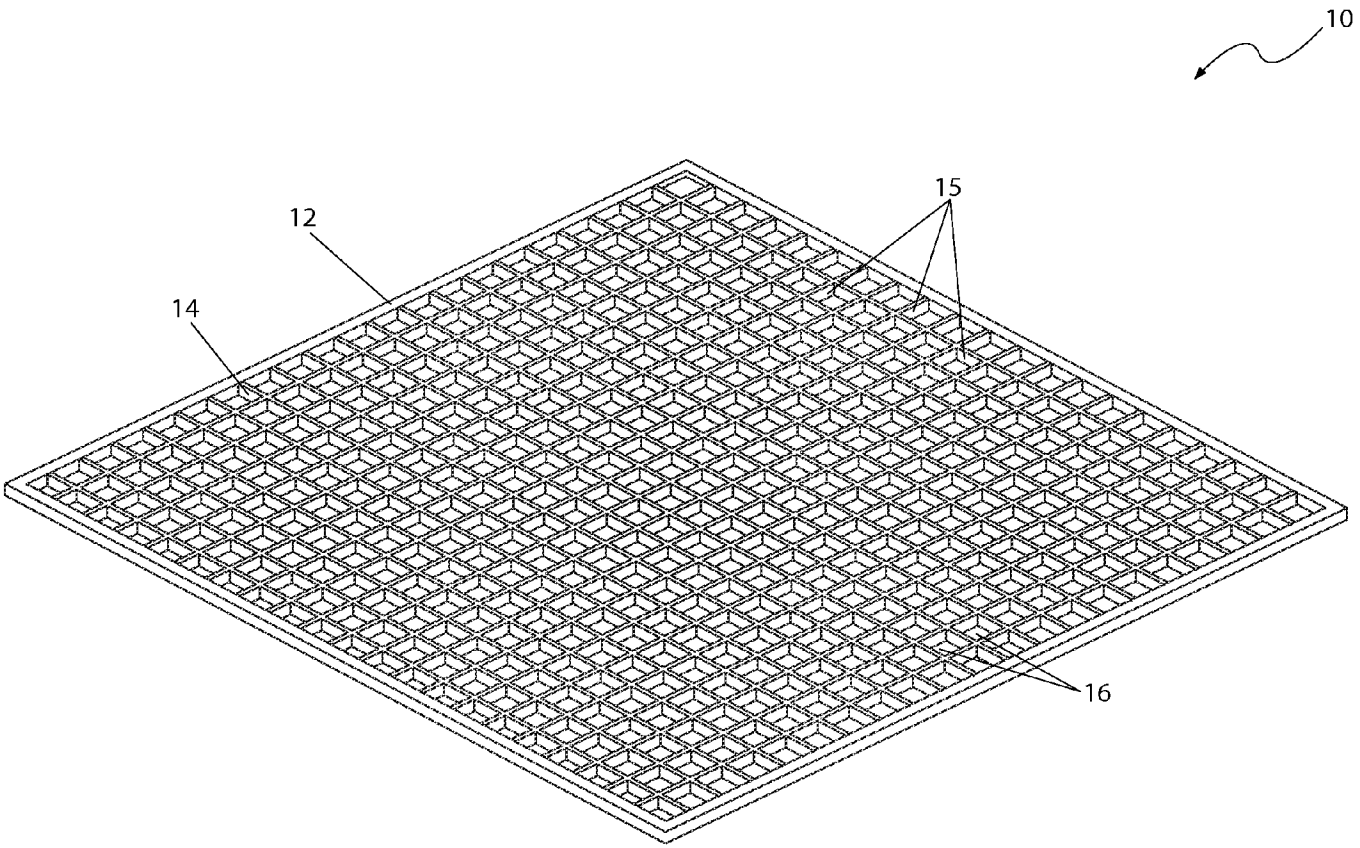
FIG. 4 is an alternate embodiment of the magnetic tile assembly 10, according to the preferred embodiment; and, FIG. 5 is a front environmental view of a plurality of magnetic tile assemblies 10 installed on a wall 100, according to the preferred embodiment.

Referring now to FIG. 4, an alternate embodiment of the assembly 10, is disclosed. In at least one (1) other embodiment, the mesh 14 is affixed to the tile 12 during manufacture and the assemblies 10 are attached to the wall 100 with the adhesive 102 during installation. The mesh 14 is preferably affixed with an adhesive substance during manufacture.

Figure 5:
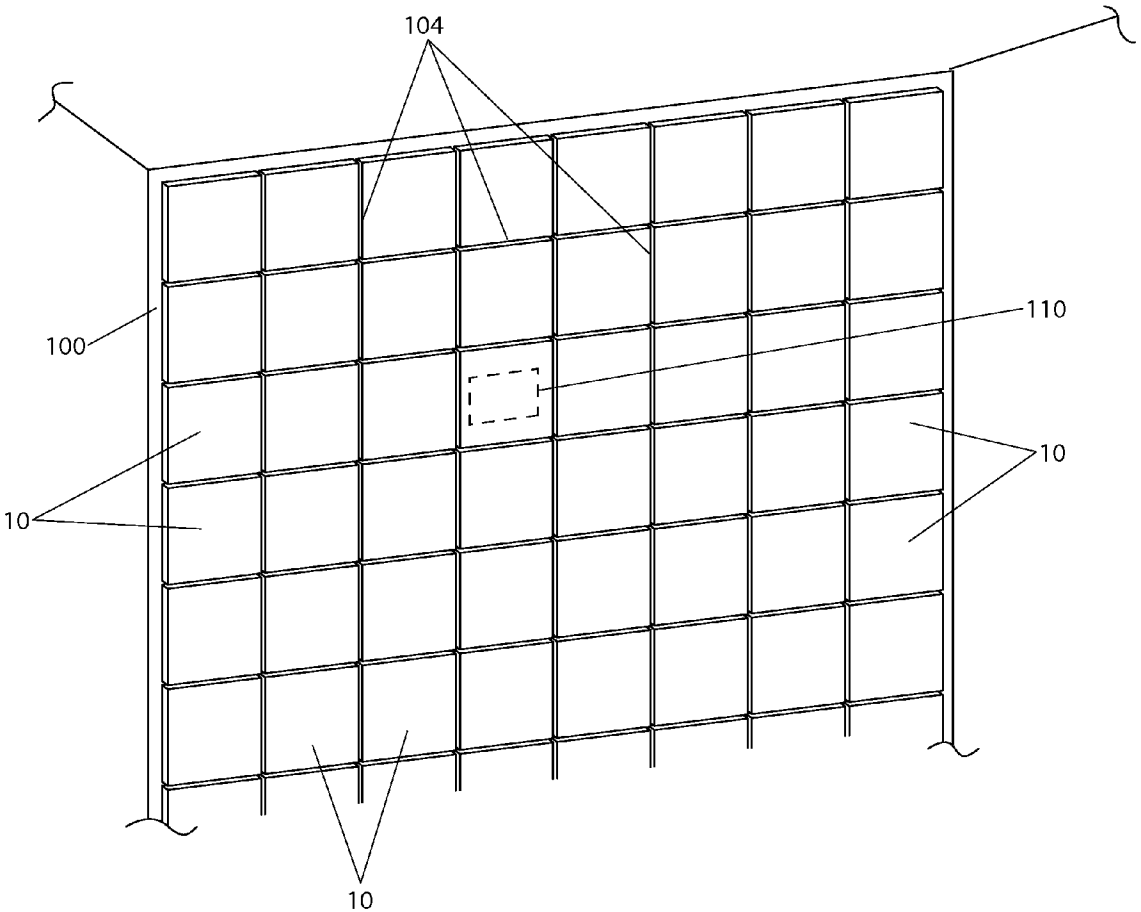

Referring now to FIG. 5, a front environmental view of a plurality of assemblies 10 installed on a wall 100, is disclosed. The magnetic tile assemblies 10 are installed in multiples to cover a desired portion of the wall 100. Once the adhesive 102 is dried, a user applies grout 104 between the assemblies 10 to inhibit moisture from reaching the wall 100. A user can place a magnetic object 110 such as a mirror, a decorative magnet, or the like against one (1) or more of the magnetic tile assemblies 10 and said object 110 will be retained in place along the exposed surfaces of the tiles 12 by the ferromagnetic meshes 14.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1 through 4.

A first method of installing the assembly 10 includes the steps of obtaining a desired plurality of magnetic tile assemblies 10 including a plurality of tiles 12 and a corresponding plurality of meshes 14; applying an adhesive 102 to a wall 100; taking one (1) tile 12 and one (1) mesh 14; placing the mesh 14 against a portion of the wall 100 coated with the adhesive 102; placing the rear surface of the tile 12 against the mesh 14 so that the tile 12 hides the mesh 14 and contacts the adhesive 102 through the apertures 16 in the mesh 14; installing each of the plurality of tiles 12 and meshes 14 in this manner; allowing the adhesive 102 to dry; applying grout 104 to the spaces between the plurality of installed magnetic tile assemblies 10; smoothing the grout 104 to evenly fill the spaces between the plurality of installed magnetic tile assemblies 10; allowing the grout 104 to dry; and, utilizing the fully installed plurality of magnetic tile assemblies 10 to temporarily secure magnetic objects 110.

A second method of installing the assembly 10 includes the steps of obtaining a desired plurality of magnetic tile assemblies 10 wherein each magnetic tile assembly 10 is manufactured with a mesh 14 affixed to a tile 12; applying an adhesive 102 to a wall 100; placing the mesh 14 of each magnetic tile assembly 10 against a portion of the wall 100 coated with the adhesive 102; allowing the adhesive 102 to dry; applying grout 104 to the spaces between the plurality of installed magnetic tile assemblies 10; smoothing the grout 104 to evenly fill the spaces between the plurality of installed magnetic tile assemblies 10; allowing the grout 104 to dry; and, utilizing the fully installed plurality of magnetic tile assemblies 10 to temporarily secure magnetic objects 110.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A magnetic tile assembly, comprising:

a tile structure;

a ferromagnetic mesh bonded to a rear portion of said tile structure;

wherein said tile structure is adhesively bonded to a support structure;

wherein said mesh is placed between said support structure and said tile structure;

wherein said mesh provides a magnetic attraction with a magnetic object placed on said tile; and, wherein said tile structure comprises a thickness enabling said magnetic attraction between said mesh and said magnetic object.

2. The assembly of claim 1, wherein said tile structure is water resistant.

3. The assembly of claim 2, wherein said tile structure is one of the following material: ceramic, metal, stone, glass or wood.

4. The assembly of claim 1, wherein said mesh further comprises outer dimensions not to exceed outer dimension of said tile structure.

5. The assembly of claim 4, wherein said mesh further comprises a plurality of elongated strands arranged to form a plurality of apertures;

wherein said plurality of apertures permits an adhesive to bond said tile structure to said support structure.

6. The assembly of claim 5, wherein said elongated strands are arranged in a grid pattern, wherein said plurality of apertures is each formed as a square shape.

7. The assembly of claim 1, wherein said mesh comprises one of the following materials: iron, cobalt, or nickel.

* * * * *